United States Patent [19]

Griffin

[11] 4,386,813

[45] Jun. 7, 1983

[54] CURRENT TAP GROUND CONTACT

[75] Inventor: Richard H. Griffin, Riverside, R.I.

[73] Assignee: International Telephone and Telegraph Corporation, New York, N.Y.

[21] Appl. No.: 270,088

[22] Filed: Jun. 3, 1981

[51] Int. Cl.[3] ..... H01R 13/652

[52] U.S. Cl. ..... 339/14 R; 339/157 R

[58] Field of Search ..... 339/14 R, 14 P, 157 R, 339/159 R, 159 C

[56] References Cited

U.S. PATENT DOCUMENTS 3,353,137 11/1967 Miller ..... 339/14 R
3,358,261 12/1967 Gaines et al. ..... 339/14 R
3,723,948 3/1973 Wyatt et al. ..... 339/14 R X
4,240,686 12/1980 Kurbikoff ..... 339/14 R

*Primary Examiner*—Eugene F. Desmond
*Attorney, Agent, or Firm*—John T. O'Halloran

[57] ABSTRACT

A ground contact strip for use in a current tap comprises an elongated planar member having at least one D shaped arcuate loop integrally formed at a front end with the vertical arm of said D loop movably positioned within a slot in said planar member, with the vertical arm of said D loop having an inwardly extending projection for coacting with a ground plug inserted into said loop, and a front D shaped loop of the same configuration integrally formed near the other end of said planar member for also receiving a ground plug of either a U shaped or round configuration.

10 Claims, 8 Drawing Figures

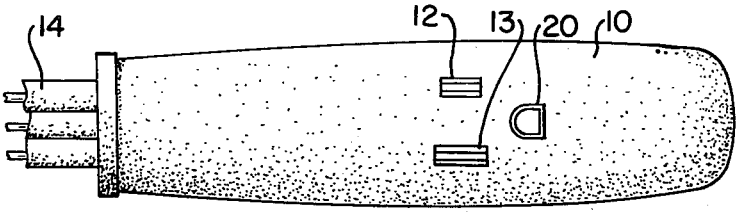
FIG. 1
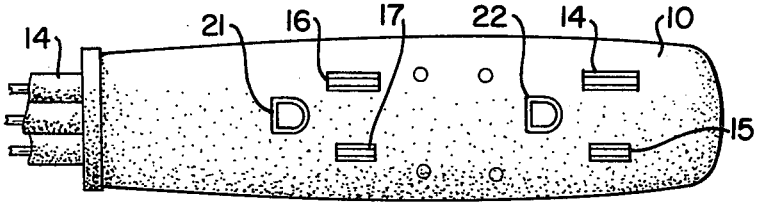
FIG. 2
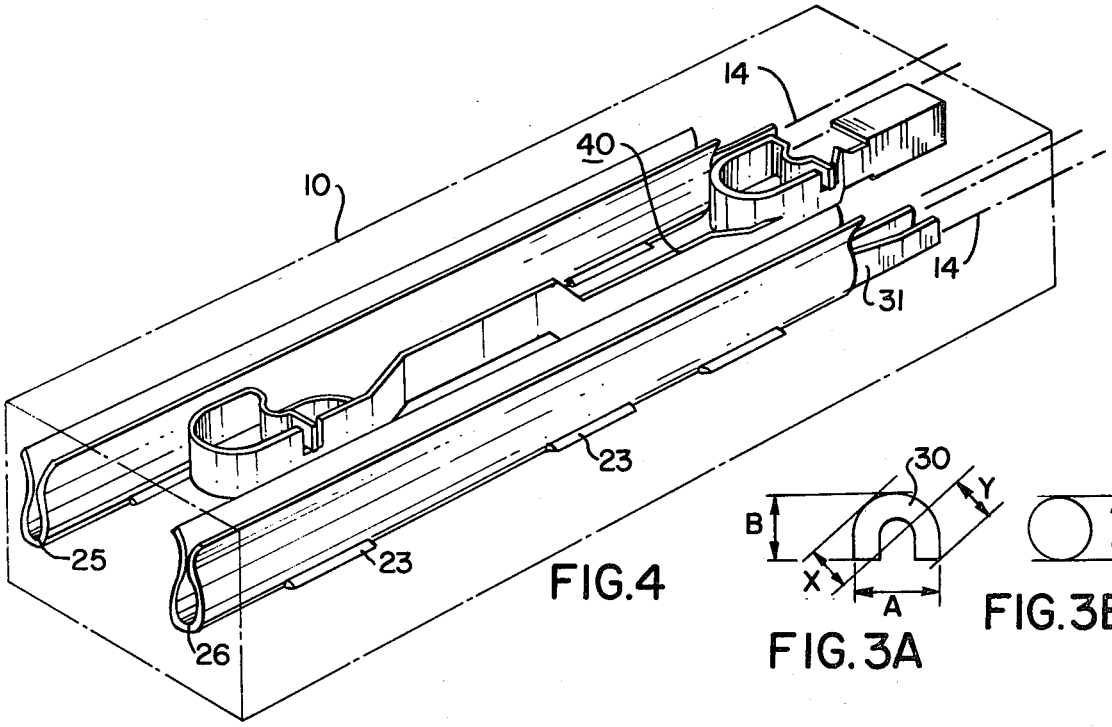
FIG. 4
FIG. 3A
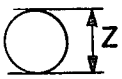
FIG. 3B
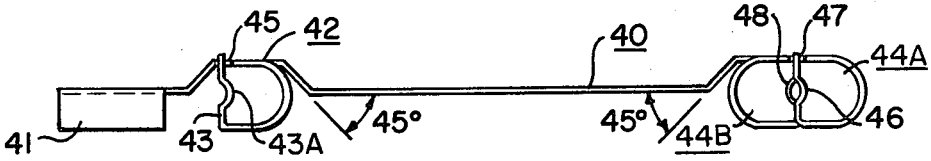
FIG. 5
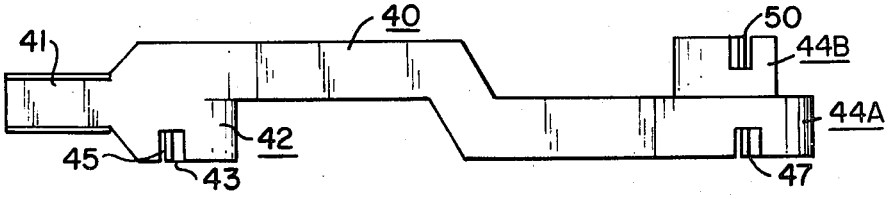
FIG. 6
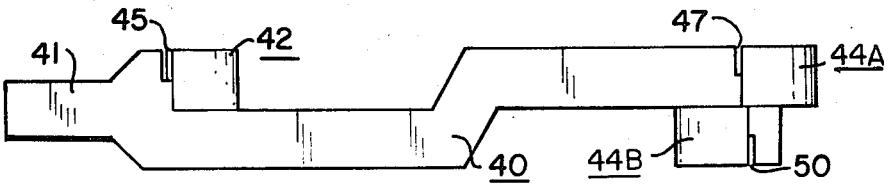
FIG. 7

CURRENT TAP GROUND CONTACT

BACKGROUND OF THE INVENTION

This invention relates to current taps such as cord connectors and convenience outlets and more particularly to a gound contact for use in a current tap.

Current taps are well known and have been employed in the prior art many years. A very popular type of current tap is depicted in U.S. Pat. No. 3,353,137 entitled CURRENT TAP WITH GROUND issued on Nov. 14, 1967 to Daniel B. Miller and assigned to the International Telephone and Telegraph Corporation, the assignee herein. As can be seen from this Patent, there is shown a current tap that comprises a molded body of resilient material which contains a pair of parallel contact strips and a ground contact strip disposed therein and adjacent to the parallel pair of contact strips. On one side of the plug body there is shown a first pair of parallel plug receivable openings and on the side opposite, second and third pairs of parallel plug receivable openings. Disposed adjacent to each pair of parallel plug receivable openings is a ground connection opening. The ground connection opening interfaces with a ground contact strip which is disposed intermediate to parallel contact strips and contains an outer loop comprised of two arcuate fingers forming a semiellipse. The contact strip also has another receptacle formed by slitting the contact strip in the middle to form a tab and shaping the tab into another semielliptical receptacle.

The current tap described in the above Patent is extremely reliable and has been in commerical use for many years. In any event, the current tap as described in that Patent must accomodate male plugs which are three pronged devices and which may have a round or a U shaped ground pin. It has been found that the device depicted in the above patent suffers in that the ground strip tends to conform to the U shaped ground pin. This occurs based on a typical use as the current tap will be used to accomodate different male plugs which are inserted and removed from the tap according to the desire of a user. Due to this fact, the shape of the receptacles as formed in the ground contact strip in U.S. Pat. No. 3,353,137 assume and conform to the U shaped ground dimensions. This occurs because the U shaped grounds have dimensions which specify the maximum allowed dimensions according to the present electrical code. On the other hand, the round ground plug conforms to the minimum dimensions.

It is therefore an object of the present invention to provide a ground contact for use in a current tap which contact will accomodate a U shaped ground found on wiring devices and also a round ground found on molded caps used on cordsets.

DESCRIPTION OF THE PREFERRED EMBODIMENT

A current tap is of the type which comprises a molded body having a first pair of parallel plug receivable openings in one side and second and third pairs of plug receivable openings in the opposite side. A ground connection opening is adjacent to each of said pair of parallel plug receivable openings, a pair of parallel contact strips are disposed in said body in adjacent relationship to said pairs of parallel plug receivable openings, in combination therewith is a ground contact strip which is a planar strip disposed between the contact strips and having a first and second D shaped loop receptacle underlying such ground connection openings associated with at least said first and second pair of receivable openings, the vertical arm of each D shaped loop extends upwardly and is retained in a corresponding slot located on the side of said strip with each slot receiving the vertical arm of said D loop to enable the arm to move when a ground plug is inserted into said associated ground opening.

BRIEF DESCRIPTION OF THE DRAWINGS

FIG. 1 is a plan view of the current tap of this invention.

FIG. 2 is a plan view of the side opposite to that of FIG. 1.

FIGS. 3A and 3B are front views depicting a U shaped and round ground plug.

FIG. 4 is a isometric view of the interior of the current tap.

FIG. 5 is a side elevation view of the ground contact strip.

FIG. 6 is a top plan view of the contact strip.

FIG. 7 is a bottom plan view of the contact strip.

DETAILED DESCRIPTION OF THE INVENTION

Referring to FIG. 1, there is shown an elongated molded body 10 having on a top side thereof a pair of parallel plug openings 12 and 13 for receiving connector plug blades. In FIG. 2, the opposite side of the body 10 is shown and contains two other pairs of parallel plug openings 14 & 15 and 16 & 17. It is observed from FIGS. 1 and 2 that the plug openings 12, 15 and 17 are shorter than the plug openings 13, 14 and 16. This is in accordance with Underwriter Laboratory requirements which state that a three wire device with provision for ground must be polarized. The current tap 10 must accomodate a two wire polarized attachment plug, which has one blade ¼" wide and the other blades 5/16" wide. It is further required that one should not be able to insert a two wire polarized plug with manual force in the incorrect position. In FIGS. 1 and 2, shown adjacent to each pair of parallel plug receivable openings and along the axis of the molded body 10, there are semielliptical openings 20, 21 and 22 adapted to receive the ground connector plugs of a male receptacle with ground. The usual male receptacle consists of a pair of parallel blades each of which has a rectangular cross section and further a ground pin which is either a round or U shaped pin and the blades and the ground pin are adapted to fit and be received in the openings of the current tap.

Referring to FIG. 3A, there is shown a U shaped ground pin 30. The ground pin 30 has a dimension A which is 0.190". The dimension B is also 0.190". In any event, the dimension Y which is a radial dimension is equal to the radius of the U shaped plug divided by the sine of 45°. The radius of the plug is 0.095" and therefore the dimension Y is 0.134". The dimension X is equal to a radius and is 0.095". Hence, $X+Y=0.229$".

In FIG. 3B the diameter Z of the round ground is 0.190". Hence, if a U shaped ground is inserted into a prior art receptacle as shown in FIGS. 1 and 2, the dimension of 0.229 will cause the receptacles of the prior art ground strip to expand and to become deformed and thus provide a condition where no ground contact would be made upon insertion of a round ground into the same receptacle.

It is further understood that due to the differences as noted above, the prior art ground strip may be dimensioned so that it could not properly accomodate a round ground pin. If reference is made to U.S. Pat. No. 3,353,137, FIGS. 9 and 10 show a side and top view of a prior art ground strip.

Referring to FIG. 4, there is shown an isometric view of the interior of the current tap 10 showing a ground strip 40 according to this invention which ground strip is disposed between two contact strips 25 and 26. The contact strips 25 and 26 are disposed within the body 10 parallel to the long axis in a position where the elongated connector blade openings of the molded body are adjacent to contact strip and parallel thereto. The contact strip 30 is disposed in the connector body along the long axis and intermediate the contact strips 25 and 26. The contact strips 25 and 26 further have openings 23 at the under surface to allow connector blades to pass through the openings as fully described in U.S. Pat. No. 3,353,137. Also shown in that Patent are detailed drawings and description of the contact strip 25 and 26 as shown in FIGS. 5, 6, 7 and 8. Essentially, each of the contact strips 25 and 26 comprises a U shaped member, one end of which has a U shaped channel 31 for receiving a connector wire as 14. The edges of the contact strip are pinched together along the length and flare outwardly to provide an easy access and entry for the connector blades of the male receptacle. The above noted Patent fully describes the contact strips 25 and 26, which strips are employed in the current tap shown in FIG. 4.

Referring to FIG. 5, there is shown a side view of the ground contact strip according to this invention. The ground contact strip 40 has a front U shaped channel 41 to accomodate a wire as 14. A first receptacle 42 is integrally formed from the strip 40 and is a D shaped configuration. The arm 43A of the D has a central extending projection 44 with the top of the arm positioned in a slot 45 formed in the strip. A slot 45 controls the amount of movement of arm 43 with respect to the arcuate section. The projecting tab as indicated and further shown in the top view of FIG. 6 rests in the slot 45. FIG. 6 depicts the top of the U shaped channel 41 for receiving a wire as 14.

The D shaped arcuate section 42 is integrally formed from the contact strip 40, which is a single piece of cut sheet metal stock as 70/30 brass of approximately 0.025" thick.

The body of central strip 40 is bent at a 45 degree angle and directed toward two front arcuate loops or receptacles 44A and 44B. Receptacle 44A is a D shaped receptacle as 42 and has an indented arm to form an inwardly extending projection 46, with the top of the arm extending into a corresponding slot 47 in the strip 40. Receptacle 44B is also of a D shaped or arcuate configuration but directed in the opposite sense from sections 42 and 44B. The arcuate D loop 44B has a projection 48 on its arm and has the arm extending within a slot 50 in the strip.

The central portion of the strip 40 is angled downwardly towards the arcuate receptacles 44A and 44B to conserve material.

FIG. 7 is a bottom view of the contact strip.

Thus as can be ascertained from FIGS. 5, 6 & 7 the sections or receptacles 42, 44A & 44B are adapted to receive a U shaped or round ground pin from a male plug as inserted into the ground pin openings 20, 21 & 22 of the current tap 10.

The projections on the arm of the D shaped receptacle sections assure the maintenance of good contact with round or U shaped ground pins as an interference fit will always be provided. The projecting tabs as positioned in the slots assure that the D shaped receptacle sections do not deform as the movement of the vertical arm of the D is limited by the slots.

As can be seen the entire contact strip is stamped from the metal stock with the arcuate D sections formed in a progressive die.

The length of the strip 40 from front to end is 2.75", with the height of each arcuate section from top to bottom being 0.192" typical with the projections being 0.110", with the width and length of the slots being 0.093", with the width of each arcuate section being 0.192".

The shape and structure of the strip as compared to the prior art ground strip requires more material while providing greater flexibility in allowing contact to be assured with both round and U shaped ground pins.

It is thus understood that various modifications and alterations could be made by those skilled in the art without departing from the spirit and scope of the invention and objects as specified in the claims appended hereto.

What is claimed is:

1. In a current tap of the type comprising a molded body having a first pair of parallel plug receivable openings in one side of said body, second and third pairs of parallel plug receivable openings in the opposite side of said body, a ground connection opening adjacent each of said pair of parallel plug receivable openings, a pair of parallel contact strips disposed in said body in adjacent relationship to said pairs of parallel plug receivable openings, the combination therewith of a ground contact strip comprising:

a generally planar strip disposed between said contact strips and including first and second D shaped loop receptacles each underlying one of said ground connection openings associated with said first and second pair of receivable openings, and having an arcuate front portion terminating at a location spaced from said strip and an arm extending toward said strip, said strip further including first and second slots in said strip, each said slot being adjacent the end of one of said arms for receiving the same to allow each said arm to move when a ground plug is inserted into said associated ground opening.

2. The combination and ground contact strip according to claim 1 wherein each of said arms of said D shaped loops has a projection extending inwardly towards said arcuate front portion of said D configuration for assuring contact with a round ground plug.

3. The combination and ground contact strip according to claim 1 wherein said first and second D shaped loops are mirror images of each other.

4. The combination and ground contact strip according to claim 1 further including:

a third D shaped loop receptacle on said planar strip and underlying said ground connection opening associated with said third pair of receivable openings, with said third D shaped loop receptacle of the same configuration as said first and second, wherein the end of the arm thereof extends toward a third slot in said strip adjacent the end of said arm for receiving the same to allow said arm to move when a ground plug is inserted into said associated ground opening.

5. The combination and ground contact strip according to claim 4 further including:

a U shaped channel formed at the end of said planar strip closest to said third D shaped loop for receiving a ground wire.

6. The combination and contact strip according to claim 1 wherein said planar strip is integrally formed with said D shaped loops.

7. The combination and contact strip according to claim 1 wherein said planar strip is fabricated from brass.

8. The combination and contact strip according to claim 5 wherein said planar strip has a first planar section extending in a first plane from said channel and then in a second plane in a central region containing said third D shaped loop and then in said first plane towards said first and second loops.

9. The combination and contact strip according to claim 1 wherein said ground plug has a round or U shaped cross section.

10. A current tap comprising a pair of plug receivable openings with a ground connection opening adjacent thereto, a pair of contacts in adjacent relationship to said pair of plug receivable openings, and a ground contact means in adjacent relationship to ground connection opening, wherein:

said ground contact means includes a generally planar strip;

said generally planar strip includes a D shaped loop receptacle underlying said ground connection opening and having an arcuate front portion terminating at a location spaced from said strip and an arm extending toward said strip; and said generally planar strip further includes a slot therein adjacent the end of said arm for receiving the same to allow said arm to move when a ground plug is inserted into said ground opening.

* * * * *